US005134818A

United States Patent [19]

Van Parera

[11] Patent Number: 5,134,818

[45] Date of Patent: Aug. 4, 1992

[54] SHOCK ABSORBER FOR BUILDINGS

[76] Inventor: Wim Van Parera, Primsengracht 508, Amsterdam, Netherlands

[21] Appl. No.: 446,951

[22] Filed: Dec. 6, 1989

[51] Int. Cl.[5] ..... E02D 27/34

[52] U.S. Cl. ..... 52/167 R

[58] Field of Search ..... 52/167; 248/638, 636, 248/661

[56] References Cited

U.S. PATENT DOCUMENTS

| | | | |
|---|---|---|---|
| 1,761,321 | 6/1930 | Wells | 52/167 R |
| 2,690,074 | 9/1954 | Jones . | |
| 2,756,952 | 7/1956 | Gazley | 248/638 X |
| 3,606,704 | 5/1969 | Denton | 52/167 R |
| 3,981,114 | 9/1976 | Chupick | 52/167 R X |
| 4,106,301 | 8/1978 | Gerwick, Jr. . | |
| 4,275,802 | 6/1981 | de Groot et al. | 248/636 X |
| 4,281,487 | 8/1981 | Koller . | |
| 4,408,744 | 10/1983 | Thompson | 248/636 |
| 4,496,130 | 1/1985 | Toyama . | |
| 4,595,167 | 6/1986 | Tangorra et al. | 248/638 |
| 4,633,628 | 1/1987 | Mostaghel | 52/167 R |
| 4,644,714 | 2/1987 | Zayas . | |
| 4,726,161 | 2/1988 | Yaghoubian . | |
| 4,731,966 | 3/1988 | Fujita et al. . | |
| 4,761,925 | 8/1988 | Fukahori et al. . | |
| 4,782,541 | 11/1981 | Tuchman . | |
| 4,967,870 | 11/1990 | Airhart | 248/638 X |

*Primary Examiner*—David A. Scherbel
*Assistant Examiner*—Lan Mai
*Attorney, Agent, or Firm*—Townsend and Townsend

[57] ABSTRACT

This invention relates to a support for a building or structure. The support consists of an outer container, typically of square or circular cross section. A movable assembly having a variable length is disposed within the container. The assembly has a plurality of vertical jointed legs mounted radially about a longitudinal center axis. The legs are mounted on a spring within the container at their lower ends and are rigidly fastened to the bottom floor of the building at their upper end. The legs contact the container wall at the legs' central portions. Movement of the top portion of the legs away from the assembly axis causes one or more of the legs to move away from the container wall while pushing the remaining leg or legs into the container wall. This movement causes the jointed legs to extend against the action of the spring thereby translating lateral movement of the container wall into vertical movement of the assembly.

17 Claims, 6 Drawing Sheets

SHOCK ABSORBER FOR BUILDINGS

BACKGROUND OF THE INVENTION

This invention relates to supports in general and to earthquake shock absorbers for buildings in particular.

Earthquakes cause structural damage to buildings in at least two ways. First, the lateral movement of the ground and, therefore, of the building foundation with respect to the building creates damaging shear forces in the building's structure. These shear forces can crack masonry, buckle vertical supports, and completely undermine the structural integrity of the building.

Second, the rhythmic movement of the ground during an earthquake can induce resonant oscillations of the building structure. These resonant oscillations magnify and prolong the destructive effects of the earthquake and add to the damage to the building.

The prior art is replete with structural supports for buildings and equipment which purportedly minimize the effects of earthquakes. Many of these designs are ineffective because they do not adequately address both modes of potential earthquake damage. In addition, many of the prior art designs require repair or even replacement after each sizable earthquake and are therefore economically impractical. Furthermore, most prior art earthquake supports are expensive and difficult to construct and install.

SUMMARY OF THE INVENTION

What is needed, therefore, is a support design that minimizes the effects of structural damage from lateral ground movements during an earthquake. This support design must also minimize the damage from earthquake-induced harmonic resonance within the structure. Finally, the support design must be economical and easily constructed.

My invention meets these needs by providing a support which permits the building foundation to move laterally with respect to the building, thereby minimizing the shear stresses on the building structure. The support according to this invention also has a damping mechanism which minimizes harmonic oscillation of the building. Finally, this new support is relatively inexpensive and is easy to construct and install.

The support consists of an outer container, typically of either square or circular cross-section. A movable assembly having a variable length is disposed within the container. The assembly has a plurality of vertical jointed legs mounted radially about a longitudinal center axis. The legs are fastened to the building's foundation at their lower ends, preferably through a series of prestressed springs. The legs contact the container wall at the legs' central portions. The legs are rigidly fastened to the frame of the building, typically the bottom floor of the building, at the legs' upper ends. Movement of the top portions of the legs away from the container axis causes one or more of the legs to move away from the container wall while pushing the remaining leg or legs into the container wall. This movement causes the jointed legs to extend. In the preferred embodiment, extension of the legs causes the spring beneath the legs to compress. In alternative embodiments, the spring beneath the legs is omitted, and extension of the legs raises the top of the support upward, thereby raising the building or structure slightly. Thus, the support translates lateral movement of the top of the assembly with respect to the bottom of the assembly into vertical movement of the assembly.

A central support member can also be used to help position the jointed legs. The central support member preferably has an internal spring mechanism. The four jointed legs are movably attached to the two ends of the central support member and are spaced from the central support member at its center by radially extending jointed supports. This central interconnection of the support's legs distributes the downward force on the support evenly among the legs.

The invention is described more particularly below with reference to the drawings.

DETAILED DESCRIPTION OF THE PREFERRED EMBODIMENTS

Figure 1:
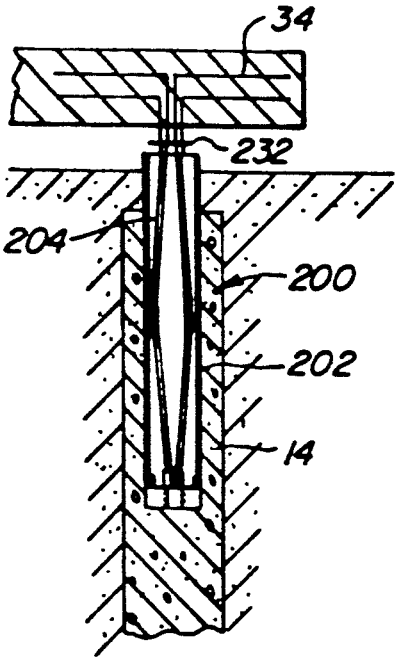
FIG. 1 is a sectional view of the shock absorber of this invention as used with a structure.
Figure 2:
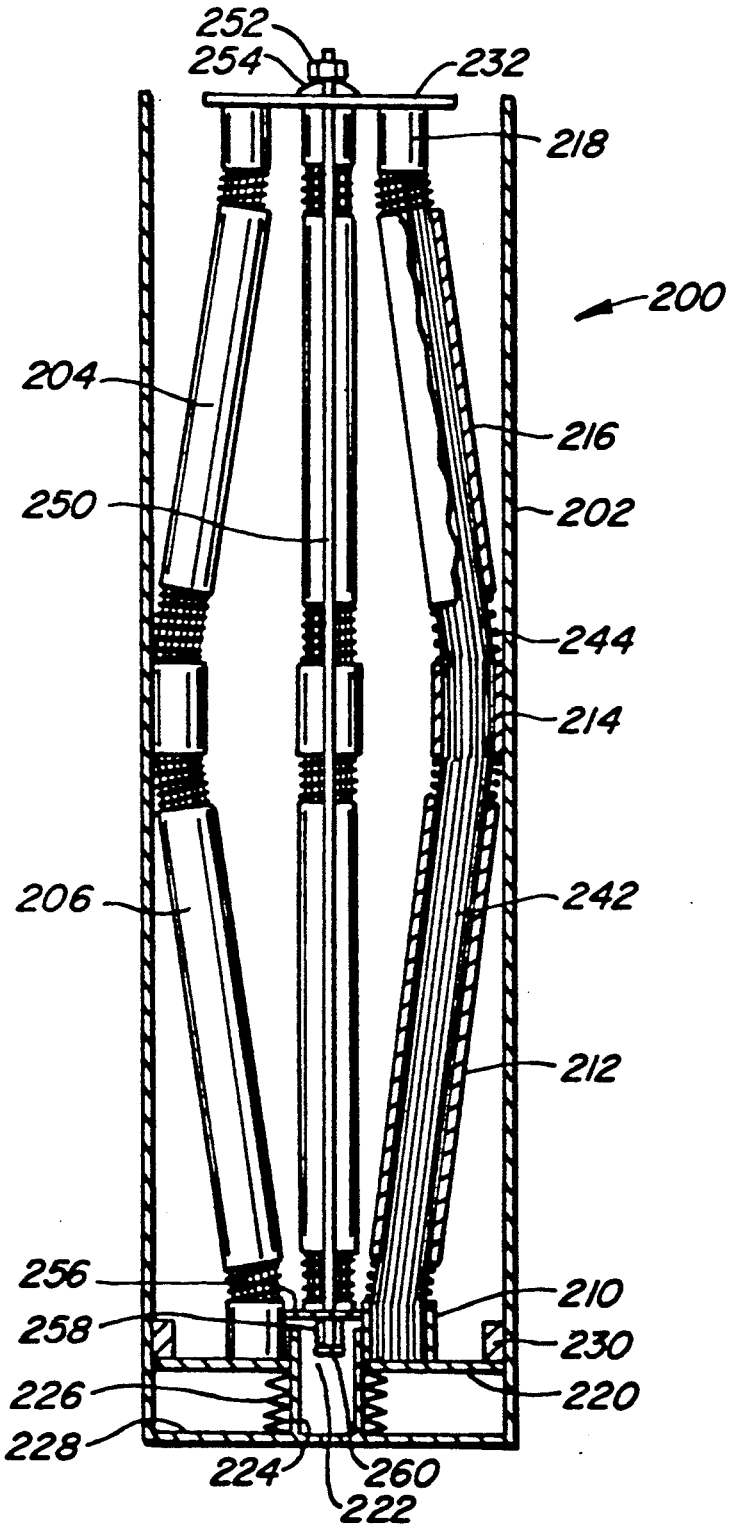
FIG. 2 is a sectional view of the shock absorber according to the preferred embodiment.

FIGS. 1 and 2 show the preferred embodiment of this invention. As shown in FIG. 2, the support 200 has two parts: a container 202 and a variable length assembly 204. Container 202 is preferably a steel tube having a square cross section. The diameter of container 202 varies with the application. In the preferred embodiment shown in FIG. 2, container 202 has an outer diameter of approximately 400 mm. A cavity of a square cross section formed in the supported structure's foundation may be substituted for container 202.

The bottom of container 202 is disposed in a standard concrete piling 14. Piling 14 is buried in the ground beneath the building and has a thickness and depth which is dependent upon the application. The size, shape and construction of these pilings is well known in the building construction art. The invention can be used with other types of foundation as well.

As shown in FIG. 1, a plurality of reinforcement bars 34 are welded to and extend upward from plate 232. Bars 34 extend into the bottom surface of the building or structure supported by assembly 204 to attach the assembly to the structure. Any other suitable method of attaching the top of assembly 204 to the structure may be used as well.

Figure 3:
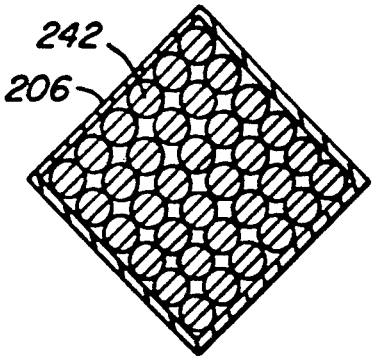
FIG. 3 is a sectional view of one of the legs of the variable length assembly of the preferred embodiment.

Assembly 204 has four segmented longitudinal legs 206 spaced evenly about the longitudinal axis 208 of assembly 204. Each leg 206 has a bottom segment 210, a lower segment 212, a center segment 214, an upper segment 216, and a top segment 218. Bottom segments 210 are welded to a plate 220 slidingly disposed near the bottom of container 202. Likewise, top segments 218 of legs 206 are attached to a top plate 232, preferably by welding. All leg segments preferably have square cross sections, as shown in FIG. 3. For the sake of clarity, FIG. 3 shows only three of the legs.

Figure 4C:
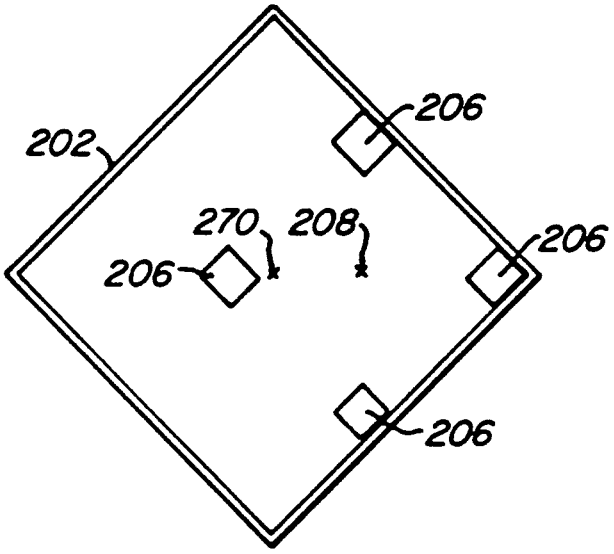
FIGS. 4A, 4B and 4C are schematic drawings showing the movement of the legs during an earthquake.
Figure 4A:
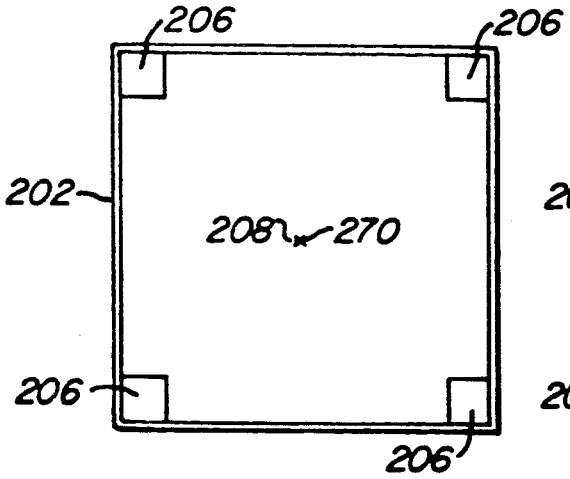

A center rod 250 extends downward from plate 232 to a mount 256 between legs 206. A spring 258 is disposed between a bottom end flange 260 on rod 250 and the underside of mount 256. Rod 250 is threaded at the top and has a nut 252 and washer 254 mounted thereon directly above plate 232. The movement of tightening nut 252 against the action of spring 258 forces legs 206 outward from the assembly center axis to their resting positions in the corners of container 202. The resting positions of center segments 214 are shown schematically in FIG. 4A.

Plate 220 has a round center hole 222 through which a guide tube 224 extends. A plurality of belville springs 226 surrounds tube 224 between plate 220 and the bottom surface 228 of container 202. Retainers 230 welded to the inner walls of container 202 maintain springs 226 in a constant state of compression. For example, if the normal load on the support is slightly less than 10 tons, the prestress of springs 226 is preferably a compression of approximately 10 tons. Plate 220 moves along guide tube 224 as the bottom of assembly 204 moves up and down within container 202. The movement of assembly 204 is discussed more particularly below.

The leg segments are separated from each other by movable joints in the following way: Joint 234 separates segments 210 and 212; joint 236 separates segments 212 and 214; joint 238 separates segments 214 and 216; and joint 240 separates segments 216 and 218. Disposed within each leg 206 is a bundle of wires 242 extending throughout all leg segments. Wires 242 are preferably a set of steel wires lying straight without twisting. The ends of wire bundles 242 are welded to plates 220 and 232. Leg segments 210–218 are separated at joints 234–240, thereby exposing portions of wire bundles 242. A plurality of tube segments surround the exposed portions of the wire bundles to prevent buckling of the wires. Segments 244 may be replaced with a metal wire or any other suitable wrapping means. Segments 244 and the exposed portions of wire bundles 242 form joints 234–240.

The preferred material for the components of support 200 is structural steel. Container 202 should be filled with oil or a synthetic lubricant to prevent corrosion of the support components. In addition, the oil serves as a damping mechanism as the variable length assembly moves through the oil.

Figure 4B:
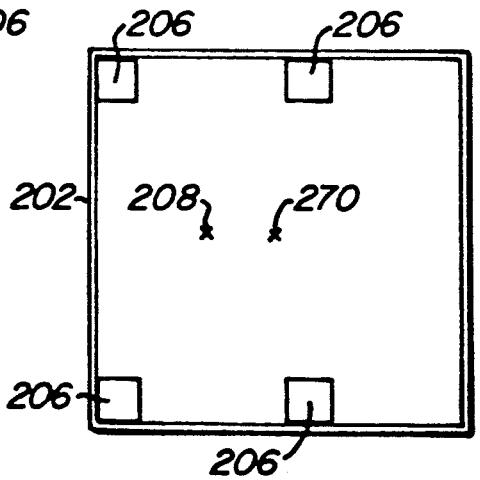
Figure 5A:
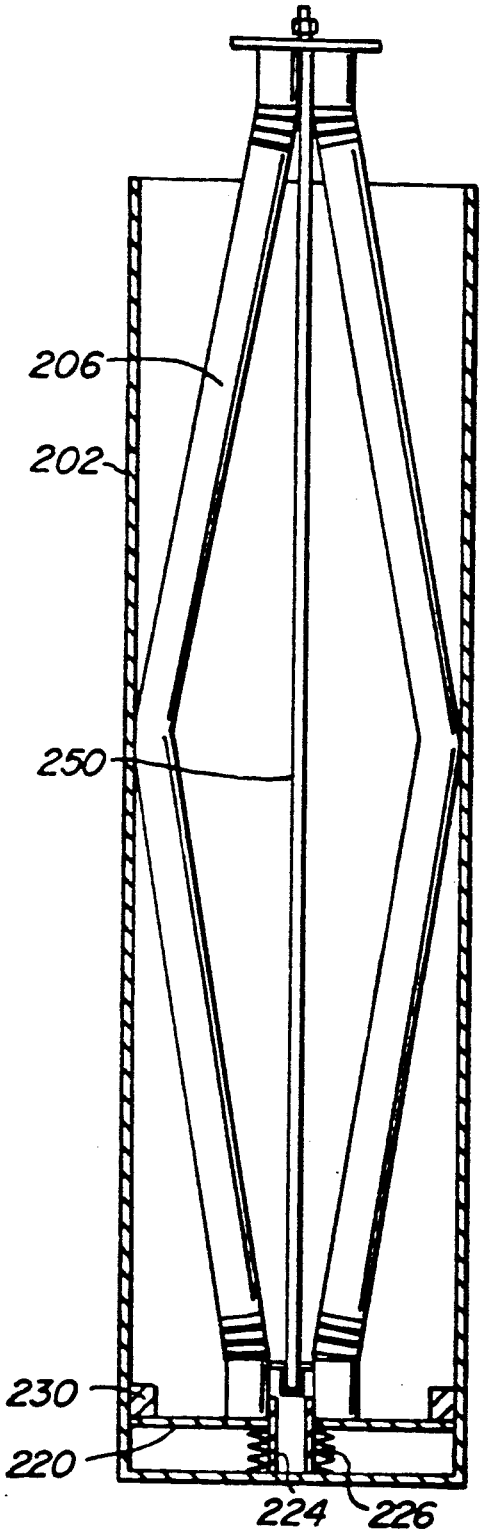
FIGS. 5A and 5B are schematic drawings showing the operation of the preferred embodiment during an earthquake.
Figure 5B:
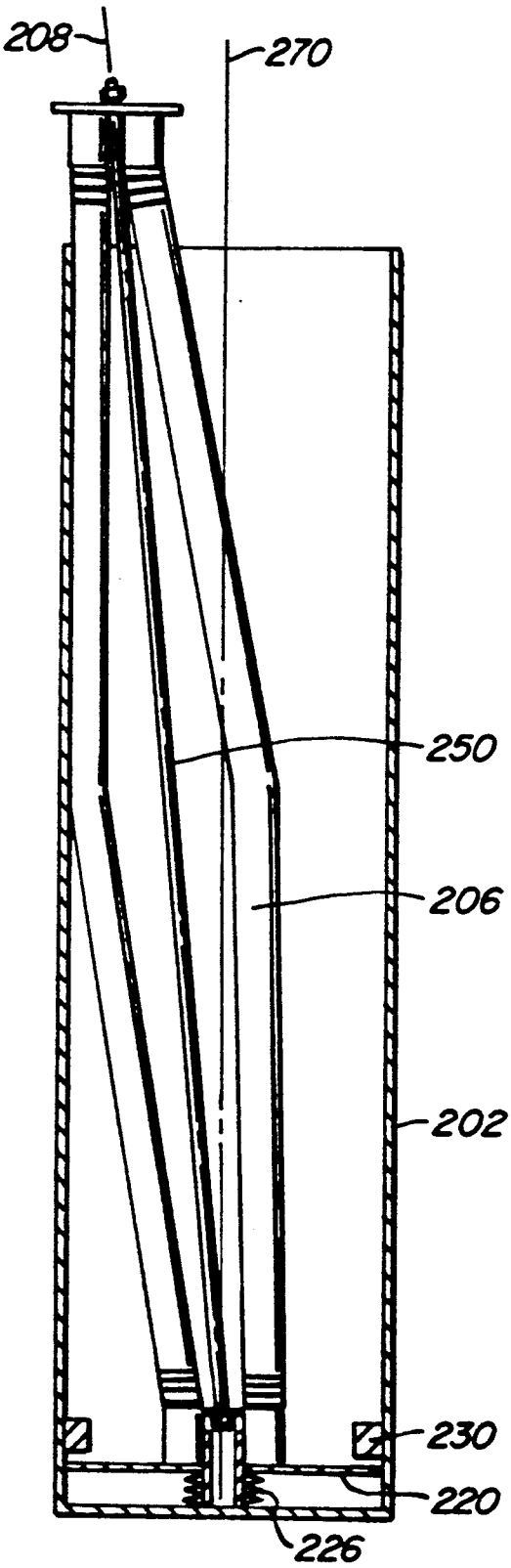

In operation, since assembly 204 is attached to the concrete piling and, therefore, to the ground (through container 202) only at its bottom end, lateral movement of the ground will cause axis 208 of assembly 204 to move away from the center axis 270 of container 202. As shown schematically in FIGS. 4 A–C, 5A and 5B, this movement will draw the center segment of at least one leg away from its corner position in container 202. The force of the center segments still lying against the container wall will cause the legs to lengthen, thereby lowering plate 220 against the action of springs 226. The presence of the oil in container 202 minimizes further movement of assembly 204 caused by harmonic oscillations of the supported structure. The force of springs 226 will move plate 220 upward after the ground movement has ceased, thereby causing legs 206 to assume their equilibrium positions.

Figure 7:
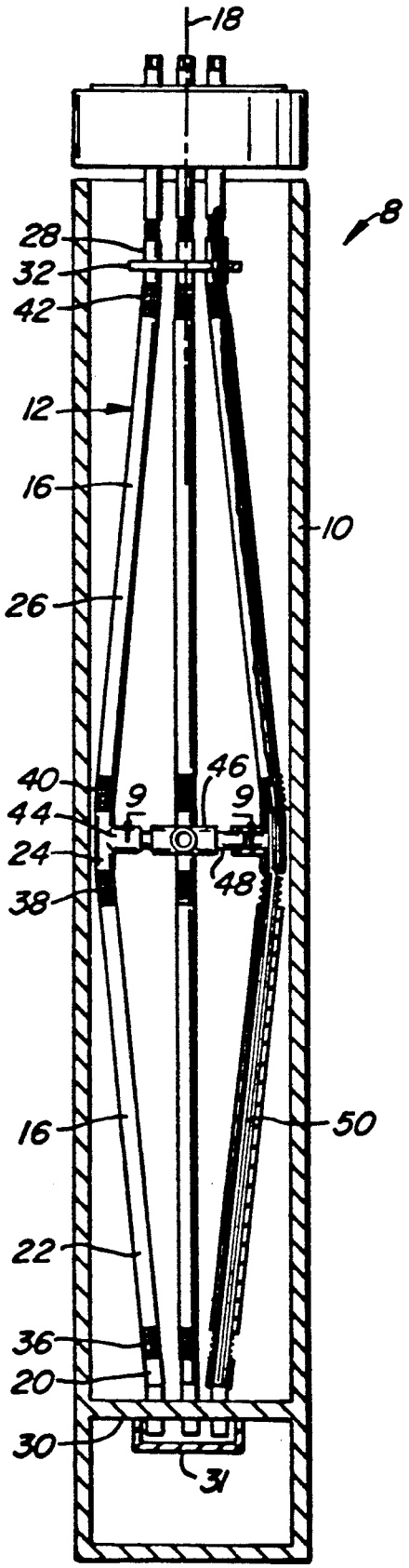
FIG. 7 is a sectional view of the shock absorber according to another alternative embodiment of this invention.

FIG. 7 shows an alternative embodiment of this invention as used with smaller buildings and other structures, such as bridges, statues, monuments, etc. As shown in FIG. 7, the support 8 has two parts: a container 10 and a variable length assembly 12 disposed within container 10. Preferably, container 10 is a standard steel tube having a diameter dependent upon the application. Alternatively, container 10 may be merely a cavity formed in the foundation in which the assembly 12 is disposed.

Assembly 12 has four segmented longitudinal legs 16 spaced evenly about the longitudinal axis 18 of assembly 12. Each leg 16 has a bottom segment 20, a lower segment 22, a center segment 24, an upper segment 26, and a top segment 28. Bottom segments 20 extend through and are bound by a steel plate 30, preferably by welding. A cap 31 covers the portions of bottom segments 20 extending below plate 30. Steel plate 30 and cap 31 are bound to the structure's foundation directly or through container 10 by bolts, welding, or any other suitable means. Likewise, top segments 28 extend through and are bound by a steel plate 32, preferably by welding.

The leg segments are separated from each other by movable joints in the following way: Joint 36 separates segments 20 and 22; joint 38 separates segments 22 and 24; joint 40 separates segments 24 and 26; and joint 42 separates segments 26 and 28. The structure and construction of joints 36–42 is discussed below.

Figure 9:
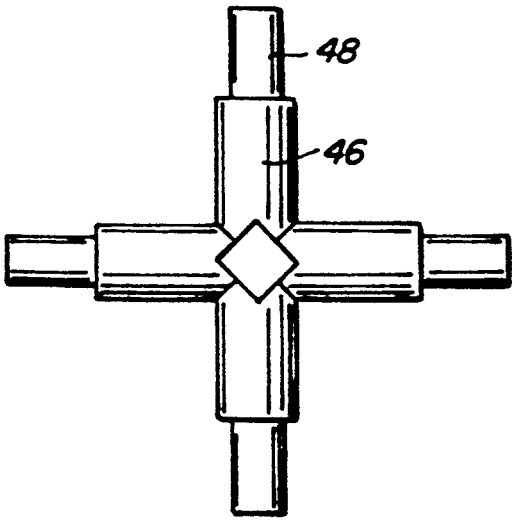
FIG. 9 is an elevational view of the cross piece according to an alternative embodiment of this invention.

Center segments 24 each have a "T" section 44 extending radially inward at a substantially 90 degree angle from segment 24 toward centerline 18. T sections 44 join a cross-shaped member 46 disposed between legs 16. As shown in FIG. 9, cross-shaped member 46 has reduced diameter portions 48 over which T sections 44 are mounted. The reduced diameter portions 48 provide a sliding connection between legs 16 and cross shaped member 46.

Alternatively, cross-shaped member 46 may have internal springs (not shown) to bias outward the center portions 24 of legs 16.

Figure 10:
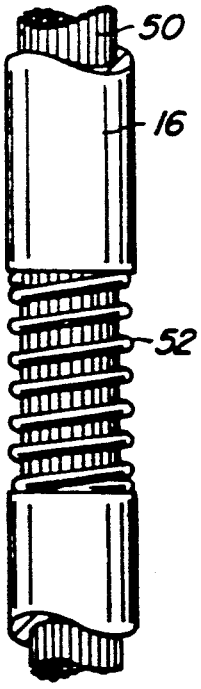
FIG. 10 is an elevational view of a hinge on one of the legs of the variable length assembly of one of the alternative embodiments.
Figure 8:
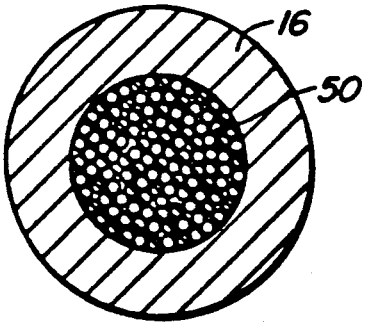
FIG. 8 is a sectional view of one of the legs of the variable length assembly in the alternative embodiments.

Disposed within each leg 16 is a bundle of wires 50 extending throughout all leg segments as shown in FIG. 8. Wires 50 are preferably a set of steel wires lying straight without twisting. The ends of wire bundles 50 are welded to steel plates 30 and 32. Leg segments 20–28 are spaced apart at joints 36–42, thereby exposing wire bundle 50. As shown in FIG. 10, a steel thread 52 is wound around the exposed portions of the wire bundles to prevent buckling of the wires. Thread 52 and the exposed portions of the wire bundle 50 form joints 36–42.

Figures 12A, 12B, 13A, 13B:
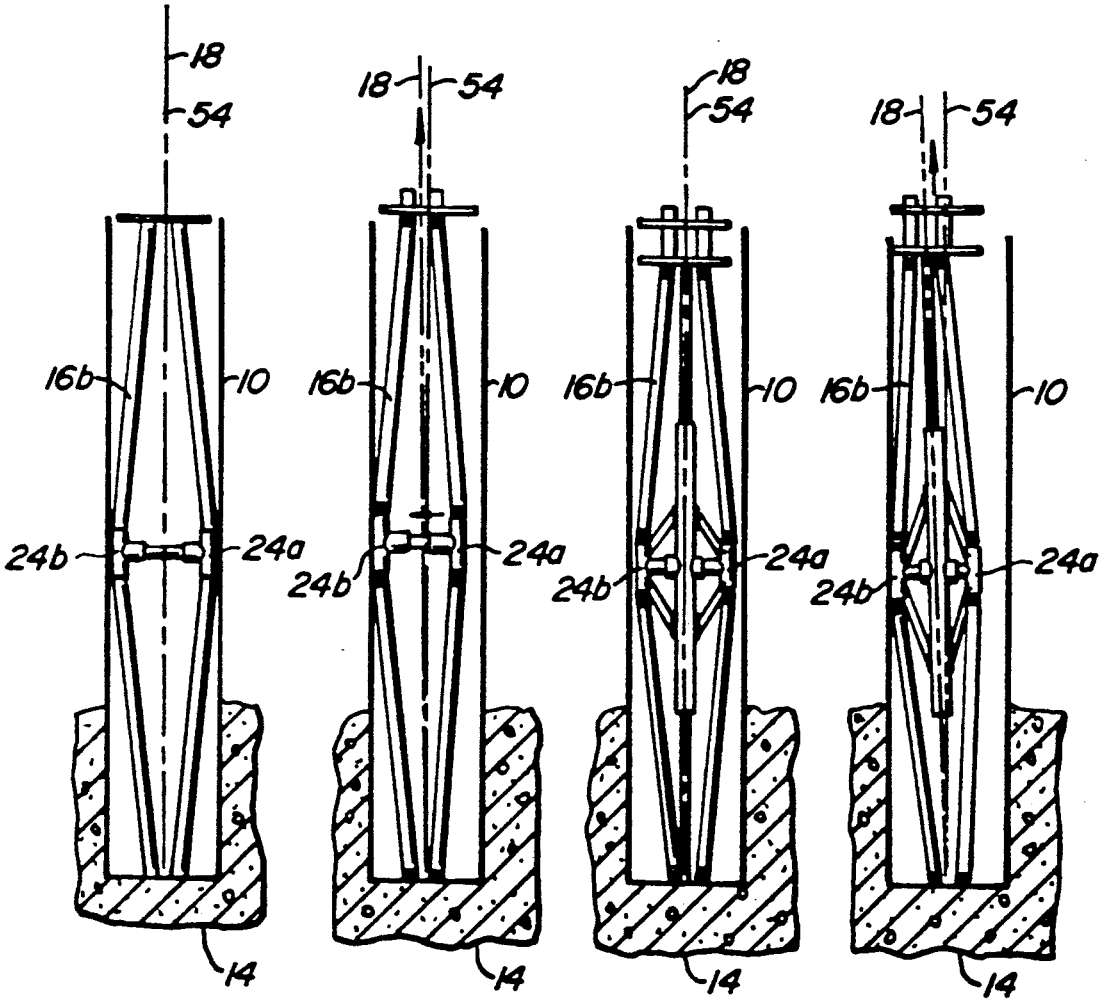
FIGS. 12A and 12B are schematic drawings showing the operation of one of the alternative embodiments of this invention during an earthquake.
FIGS. 13A and 13B are schematic drawings showing the operation of another of the alternative embodiments of this invention during an earthquake.

In operation, since support 12 is attached to the concrete piling and, therefore, to the ground (through container 10) only at its bottom end, lateral movement of the ground will cause axis 18 of assembly 12 to move away from the axis 54 of container 10. As shown schematically in FIGS. 12A and 12B, this movement will draw center segment 24a away from container 10 while forcing center segment 24b against the wall of container 10. The force of segment 24b against container 10 will cause leg 16b and, hence, all four legs to straighten, thereby raising the bottom of the building or structure a corresponding amount.

The entire weight of the building or structure supported by support 12 is temporarily on leg 16b. After the movement of the ground ceases, the weight of the building or structure will force all legs 16 to separate to their respective positions against the wall of container 10, thereby redistributing the weight of the building or structure among the four legs.

Figure 11:
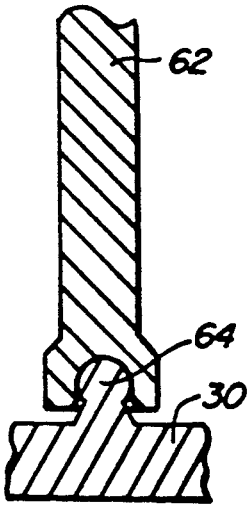
FIG. 11 is a sectional view of the mounting knob according to an alternative embodiment of this invention.
Figure 6:
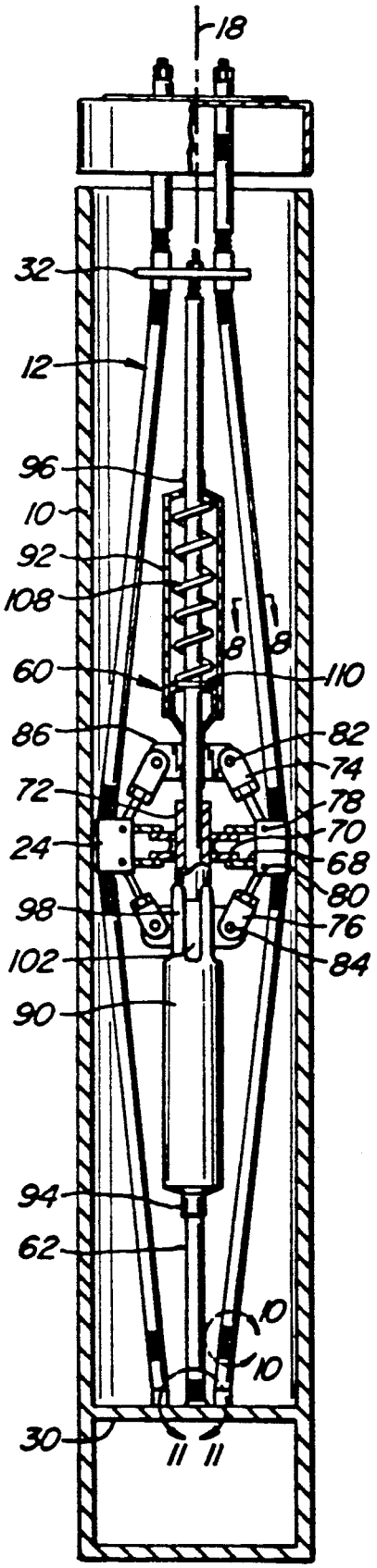
FIG. 6 is a sectional view of the shock absorber according to an alternative embodiment of this invention.

Another alternative embodiment of my invention for heavier buildings or structures is shown in FIG. 6. This embodiment adds a center support mechanism 60 disposed along axis 18 of assembly 12. Support mechanism 60 has a center post 62 which extends from plate 30 to plate 32. Post 62 surrounds a mounting knob 64 disposed on plate 30 as shown in FIG. 11. Knobs 64 and 66 maintain contact between post 62 and plates 30 and 32 when legs 16 straighten, thereby temporarily lengthening support member 12.

Extending radially inward from each center segment 24 is a hollow connector 68. Hollow connectors 68 surround and make a sliding connection with arms 70 extending radially outward from a collar 72 mounted about the center of post 62. An upwardly extending hinged member 74 and a downwardly extending hinged member 76 are mounted on hinges 78 and 80, respectively, on each hollow connector 68. Hinged members 74 and 76 are also attached to hinges 82 and 84, respectively, on sliding collars 86 and 88 surrounding post 62.

Covers 90 and 92 are disposed about post 62 and extend from collar 72 toward plates 30 and 32, respectively. Covers 90 and 92 are slidingly attached to post 62 by collars 94 and 96. At the ends adjacent the center of post 62, covers 90 and 92 have fingers 98 and 100 surrounding slots 102 and 104, respectively. The ends of fingers 98 and 100 are attached to collar 72 by bolts or by welding. Hinges 82 and 84 of collars 86 and 88 extend through slots 102 and 104. The length of slots 102 and 104 depends on the expected range of movement of collars 86 and 88 as explained below.

Springs 106 and 108 are disposed about post 62 inside covers 90 and 92. Springs 106 and 108 rest on and extend between collars 94 and 96 on one end and shoulders 110 and 112 formed on collars 86 and 88 on the other end.

As with the previous embodiment, in operation, since support 12 is attached to the concrete piling and, therefore, to the ground only at its bottom end, lateral movement of the ground will cause the centerline 18 of support 12 to move away from the centerline 54 of container 10. As shown schematically in FIGS. 13A and 13B, this movement will draw center segment 24a away from container 10 while forcing center segment 24b against the wall of container 10. The force of segment 24b against container 10 will cause leg 16b and, hence, all four legs to straighten, thereby raising the bottom of the building or structure a corresponding amount.

Unlike the previous embodiment, however, all four legs 16 are connected to each other through sliding collars 86 and 88. As legs 16 straighten, collars 86 and 88 move along post 62 away from collar 72. The weight of the building or structure on leg 16b is distributed through hinged members 74 and 76 to the remaining legs. Therefore, in contrast to the previous embodiment, the entire weight of the building or structure is not on one leg when the ground shifts.

After the movement of the ground ceases, the weight of the building or structure will force legs 16 to separate to their respective positions against the wall of container 10.

Springs 106 and 108 are optional. When used, they serve two functions. First, springs 106 and 108 assist in returning legs 16 to their fully open positions after the initial ground movement. Second, and more important, springs 106 and 10 prevent support 12 from extending due to wind force on one side of the structure. The size and tension of springs 106 and 108 are therefore selected to meet the requirements of the wind force against the side of the building while still permitting the variable length assembly to lengthen if the ground beneath the structure moves during an earthquake.

As in the previous embodiments, the container 10 is filled with oil or a synthetic lubricant to prevent corrosion of the structural steel components. The movement of this oil through the support components also serves as a damping mechanism to minimize the harmonic oscillations of the building or structure during an earthquake.

The dimensions of container 10 and of the variable length assembly 12 depend on the application. The critical parameters are the weight of the structure and the expected ground movement during an earthquake. The latter parameter depends on the seismic characteristic of the ground on which the structure is built.

Modification and variation can be made to the preferred embodiments without departing from the invention as defined in the following claims. For example, the container need not have solid sides. In addition, a greater or lesser number of legs may be used.

What is claimed is:

1. A support for a structure comprising:

a container fixed to the ground beneath the structure, the container having a longitudinal center axis;

a variable length assembly having a center axis, the assembly comprising a plurality of legs mounted substantially longitudinally within the container and arranged radially about the container axis, the legs each having a first end mounted within the container and a second end fixed to the structure, a portion of each of the legs being in contact with the container when the variable length assembly axis substantially coincides with the container axis; and means for extending the length of the legs when the ground beneath the building moves laterally with respect to the building.

2. The support of claim 1 wherein the first end of the legs is rigidly fixed to the container.

3. The support of claim 1 wherein a spring is mounted between the first end of the legs and the container.

4. The support of claim 1 wherein the means for extending comprises a joint in one of the legs, the joint acting to extend the length of the leg when the variable length assembly axis moves away from the container axis and toward the portion of the leg in contact with the container.

5. A support for a structure comprising:

a container fixed to the ground beneath the structure, the container having a longitudinal axis;

a variable length assembly having a longitudinal axis, said assembly comprising a plurality of legs mounted substantially longitudinally within the container, the legs each having a first end, a second end, and a contact portion, said contact portion being in contact with the container when the longitudinal axis of the variable length assembly substantially coincides with the container axis, the distance of said contact portion from the assembly axis being greater than the distance of the first end and of the second end from the assembly axis when the longitudinal axis of the variable length assembly substantially coincides with the container axis;

means for mounting the first end of each leg in the container;

means for fixing the second end of each leg to the structure; and means for extending the length of the variable length assembly when the contact portion of one leg moves toward the assembly axis.

6. The support of claim 5 wherein the means for mounting the first end of the legs comprises means for rigidly fixing the first end of the legs to the container.

7. The support of claim 5 wherein the means for mounting the first end of the legs comprises a spring mounted between the first end of the legs and the container.

8. The support of claim 5 wherein the means for extending comprises a joint in one of the legs, the joint acting to extend the length of the leg when the variable length assembly axis moves away from the container axis and toward the portion of the leg in contact with the container.

9. A support for a structure comprising:

a container fixed to the ground beneath the structure, the container having a longitudinal axis;

a variable length assembly having a longitudinal axis, the assembly comprising a plurality of legs mounted substantially longitudinally within the container, the legs each having a first end, a second end, and a contact portion, said contact portion being in contact with the container when the longitudinal axis of the variable length assembly substantially coincides with the container axis, the distance of said contact portion from the assembly axis being greater than the distance of the first end or the second end from the assembly axis when the longitudinal axis of the variable length assembly substantially coincides with the container axis;

means for fixing the first end of each leg relative to the ground beneath the structure;

means for fixing the second end of each leg relative to the structure; and means for extending the length of the variable length assembly when the ground moves laterally relative to the structure.

10. The support of claim 9 further comprising means for damping the movement of the support.

11. The support of claim 10 wherein the means for damping comprises a liquid disposed within the container and surrounding the variable length assembly.

12. The support of claim 9 wherein the means for extending comprises a joint in at least one of the legs, the joint acting to extend the length of the leg when the variable length assembly axis moves away from the container axis and toward the contact portion of the leg.

13. The support of claim 12 wherein each leg has a plurality of joints.

14. The support of claim 13 wherein the legs are formed from hollow segments, the joints being formed from bundles of wires disposed within the segments.

15. The support of claim 12 wherein the number of legs is four.

16. The support of claim 9 further comprising means for resisting extension of the variable length assembly.

17. The support of claim 16 wherein the means for resisting includes a spring.

* * * * *